US005123596A

United States Patent [19]

Fisher et al.

[11] Patent Number: 5,123,596

[45] Date of Patent: Jun. 23, 1992

[54] BOLTED RAIL FASTENING SYSTEM

[76] Inventors: George K. Fisher, 1616 Bellevue Blvd. North, Bellevue, Nebr. 68005; Thomas L. Wallace, 9518 "N" St., Omaha, Nebr. 68127; William C. Thompson, 1667 S. 153 St., Omaha, Nebr. 68114

[21] Appl. No.: 737,385

[22] Filed: Jul. 29, 1991

Related U.S. Application Data

[63] Continuation-in-part of Ser. No. 547,465, Jun. 29, 1990.

[51] Int. Cl.[5] ..... E01B 9/46

[52] U.S. Cl. ..... 238/342; 238/306; 238/344; 238/347

[58] Field of Search ..... 238/297, 306, 338, 342, 238/343, 344, 345, 347

[56] References Cited

U.S. PATENT DOCUMENTS

| | | | |
|---|---|---|---|
| 257,572 | 5/1882 | Haas . | |
| 1,041,188 | 10/1912 | McConnell . | |
| 1,132,827 | 3/1915 | Busch . | |
| 1,145,780 | 7/1915 | McMillan . | |
| 1,586,479 | 5/1926 | Snyder . | |
| 1,640,750 | 8/1927 | Buchholz . | |
| 1,658,665 | 2/1928 | Buchholz . | |
| 1,670,994 | 5/1928 | Snyder et al. . | |
| 1,760,723 | 5/1930 | Snyder et al. . | |
| 1,863,248 | 6/1932 | McGrew . | |
| 2,024,870 | 12/1935 | Oberg | 238/304 |
| 2,083,952 | 6/1937 | Haswell | 238/306 |
| 3,147,921 | 9/1964 | Delcroix | 238/310 |
| 4,062,490 | 12/1977 | Hixson | 238/338 |
| 4,193,544 | 3/1980 | Marchant et al. | 238/347 |

FOREIGN PATENT DOCUMENTS

| | | | |
|---|---|---|---|
| 664528 | 6/1963 | Canada | 238/163 |
| 302041 | 4/1915 | Fed. Rep. of Germany . | |
| 385241 | 11/1923 | Fed. Rep. of Germany | 238/343 |
| 473323 | 2/1929 | Fed. Rep. of Germany | 238/345 |
| 503820 | 7/1930 | Fed. Rep. of Germany | 238/347 |
| 652715 | 11/1937 | Fed. Rep. of Germany | 238/306 |
| 158442 | 4/1940 | Fed. Rep. of Germany | 238/343 |
| 810277 | 8/1951 | Fed. Rep. of Germany . | |
| 457605 | 4/1913 | France | 238/343 |
| 531536 | 1/1922 | France | 238/343 |
| 638730 | 6/1928 | France | 238/345 |
| 586543 | 12/1958 | Italy . | |
| 29217 | 10/1932 | Netherlands | 238/338 |
| 109840 | 4/1925 | Switzerland | 238/343 |
| 8524 | of 1885 | United Kingdom | 238/343 |

*Primary Examiner*—Frank E. Werner
*Assistant Examiner*—Robert S. Katz
*Attorney, Agent, or Firm*—Zarley, McKee, Thomte, Voorhees & Sease

[57] ABSTRACT

A bolted rail fastening system comprising a rail mounted in a recessed area of a tie plate with the tie plate being secured to a cross-tie by means of coach screws extending downwardly therethrough. The rail is maintained in the recessed area by a pair of clips positioned at each side of the rail which will remain in position even if the nuts associated therewith become loose.

4 Claims, 7 Drawing Sheets

BOLTED RAIL FASTENING SYSTEM

CROSS-REFERENCE TO RELATED APPLICATION

This is a continuation-in-part application of Ser. No. 07/547,465 filed on Jun. 29, 1990.

BACKGROUND OF THE INVENTION

This invention relates to a bolted rail fastening system and more particularly to a bolted rail fastening system which ensures that the rail will remain on the tie plate even if the fastening system therebetween becomes loose during use.

Historically, rails have been secured to wooden cross-ties by positioning the rail on a tie plate with the tie plate being secured to the cross-tie by means of spikes extending downwardly therethrough. The rail is normally secured to the tie plate itself by spikes extending downwardly through the tie plate into the cross-tie with the heads of the spikes being positioned above the base flange of the rail.

During use, the conventional rail fastening systems become loose due to the constant forces exerted thereon by trains passing thereover. Many different types of systems have been previously devised in an attempt to prevent the rail from becoming loose with respect to the tie plate but the same have apparently met with little success for one reason or another.

It is therefore a principal object of the invention to provide an improved bolted rail fastening system.

Yet another object of the invention is to provide a bolted rail fastening system which ensures that the rail will be restrained laterally on the tie plate even though the fastening system therebetween becomes loose during use.

Still another object of the invention is to provide a bolted rail fastening system including a novel clip positioned at opposite sides of the rail including means for maintaining the clip bolt in position should the nut thereon become loose or completely fall off.

A further object of the invention is to provide a bolted rail fastening system which facilitates the replacement of worn rails without the need for removing spikes and replacing the same thereby increasing the life of the tie.

Yet another object of the invention is to provide a bolted rail fastening system which helps to longitudinally restrain the rail thereby reducing the need for external rail restraints.

Still another object of the invention is to provide a bolted rail fastening system which is economical of manufacture, durable in use and refined in appearance.

These and other objects will become apparent to those skilled in the art.

SUMMARY OF THE INVENTION

A bolted rail fastening system is described for mounting a rail on a cross-tie through the use of a tie plate and a pair of clip assemblies mounted at opposite sides of the rail. At each side of the tie plate, a first rectangular-shaped opening is formed therein which extends downwardly therethrough. A horizontally extending slot communicates with the lower end of the first rectangular-shaped opening and extends towards the rail. A second opening communicates with the slot and extends upwardly through the tie plate. The T-shaped head of a clip bolt is inserted downwardly into the first rectangular-shaped opening and then moved inwardly in the horizontally disposed slot so that the shank of the clip bolt extends upwardly through the second opening. A clip is mounted on the upper end of the clip bolt and has an inner end portion which engages the base flange of the rail and an outer end portion which engages the tie plate at the opposite ends of the first rectangular-shaped opening. A tooth protruding from the lower end of the outer end of the clip and is received in the first rectangular-shaped opening. A nut is secured to the upper end of the clip bolt to maintain the clip in position. When the clip is so positioned, the tooth is positioned laterally of the T-shaped head portion of the clip bolt to prevent the clip bolt from rotating in the slot or moving laterally out of the slot. Even if the nut on the clip bolt should become loose or disengaged from the clip bolt, the clip remains on the upstanding clip bolt and provides lateral restraint to the rail on the tie plate. The tie plate is secured to the cross-tie by any convenient means such as coach screws extending downwardly through the tie plate into the cross-tie.

DESCRIPTION OF THE PREFERRED EMBODIMENT

Figure 1:
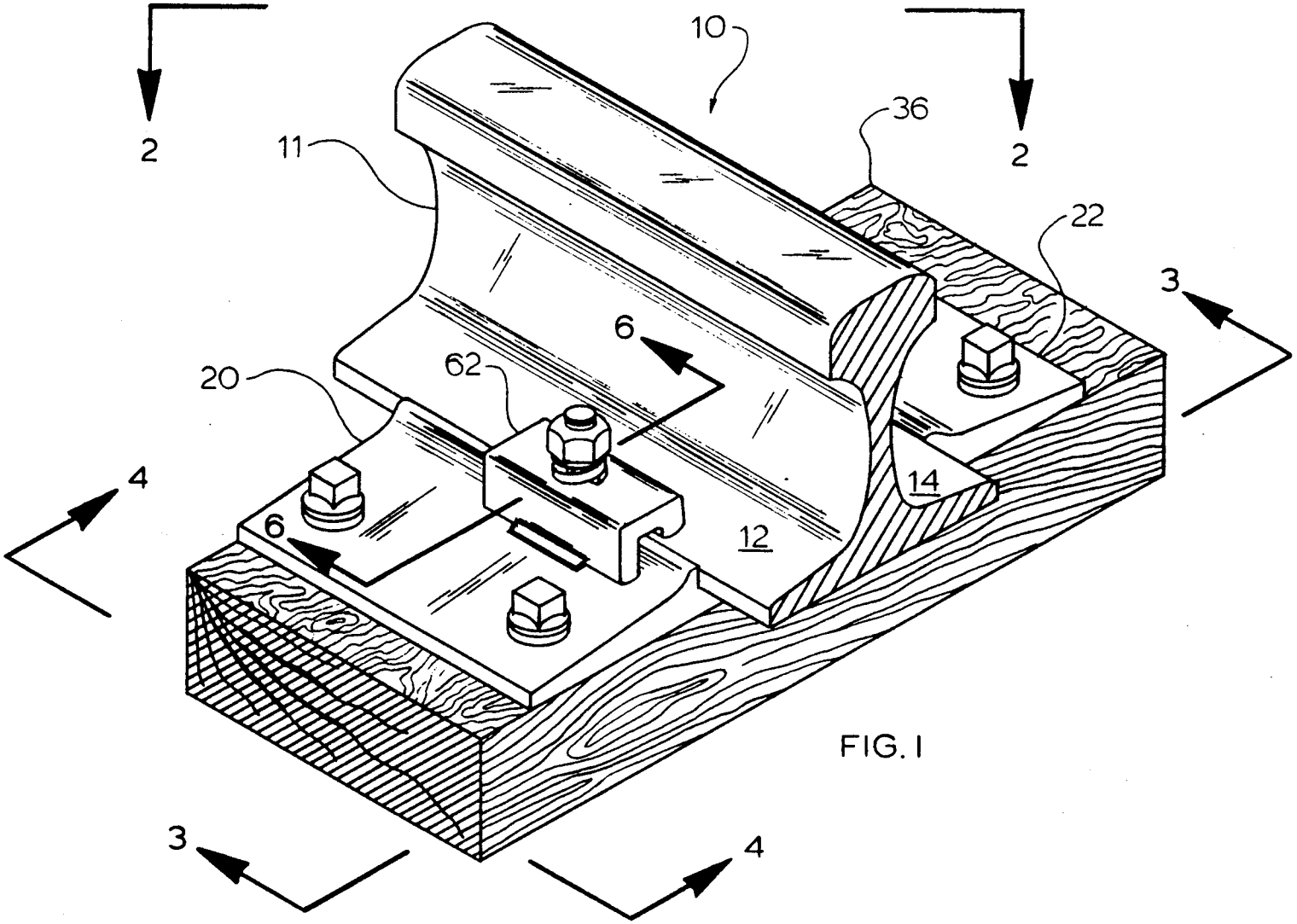
FIG. 1 is a perspective view of the bolted rail fastening system of this invention.
Figure 2:
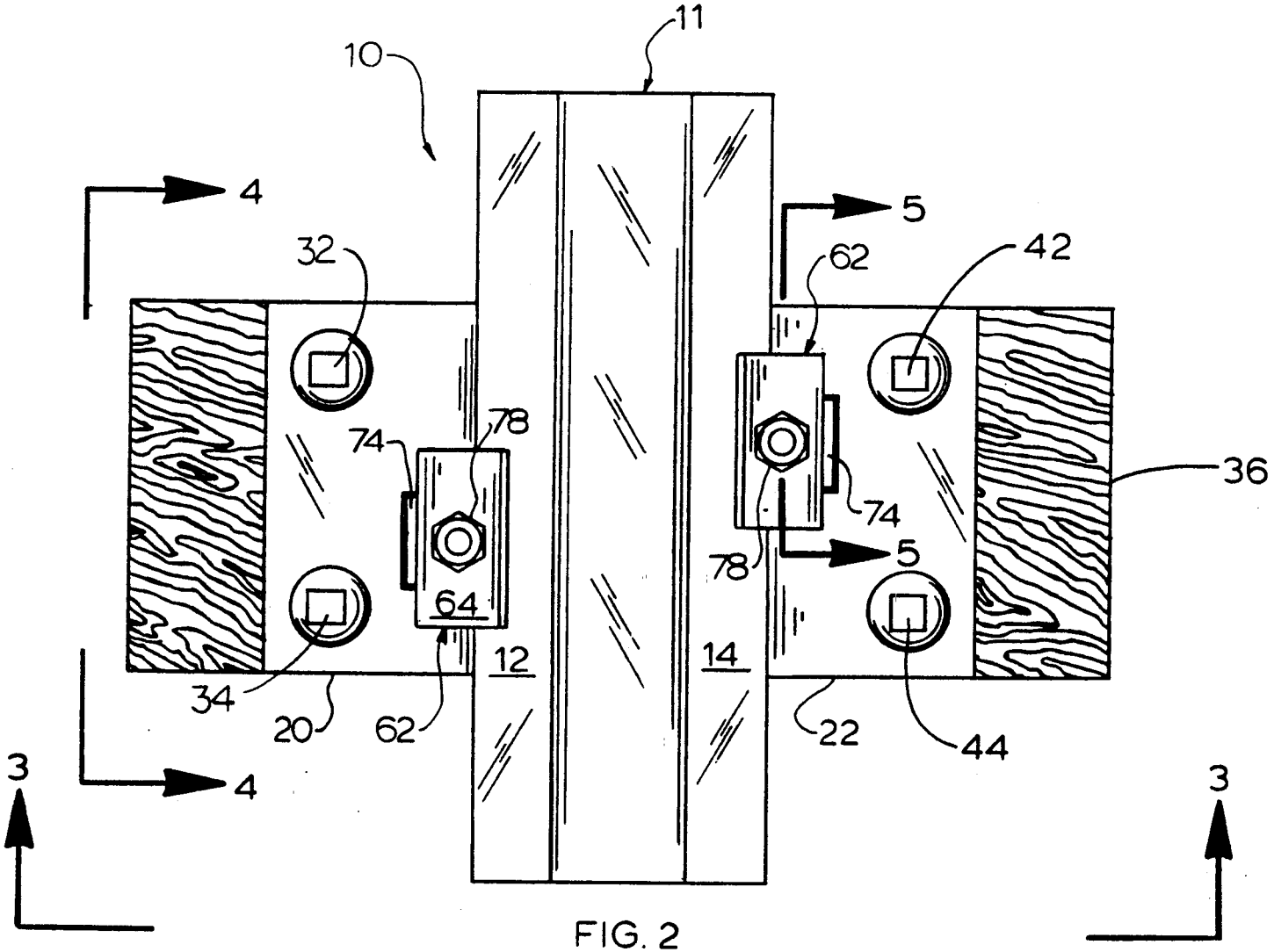
FIG. 2 is a top view of the bolted rail fastening system of this invention.
Figure 4:
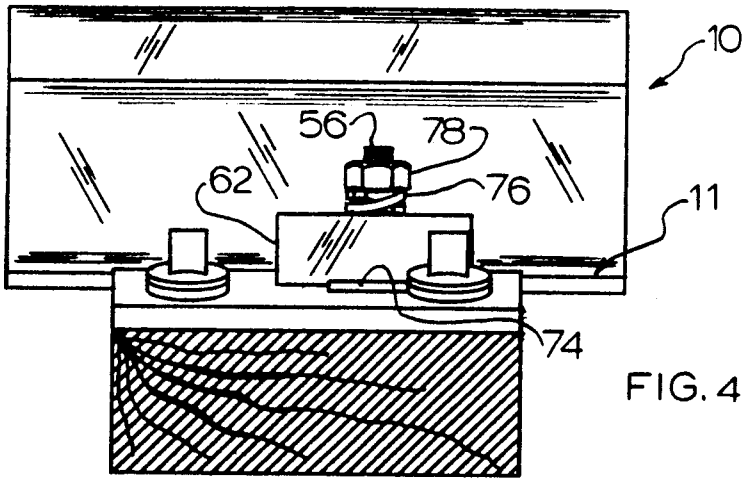
FIG. 4 is a view as seen on lines 4—4 of FIG. 2.
Figure 3:
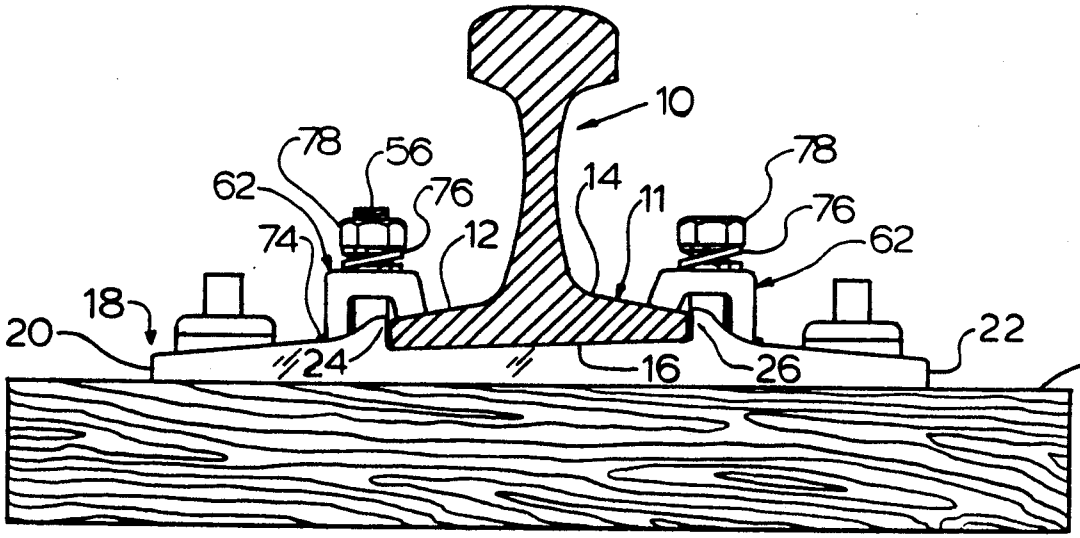
FIG. 3 is a sectional view as seen on lines 3—3 of FIG. 1.

The numeral 10 refers generally to a conventional railroad rail including a base flange 11 including flange portions 12 and 14. Rail 10 is designed to be positioned in a recessed area 16 of tie plate 18. Recessed area 16 may be horizontally disposed but may also be inclined at a 1-30 slope if so desired. In some tie plate configurations, the recessed areas are omitted. For purposes of description, tie plate 18 includes a gauge end 20 and a field end 22. As seen in FIG. 3, recessed area 16 is defined by a pair of shoulders 24 and 26.

Tie plate 18 is provided with a pair of openings 28 and 30 formed therein adapted to receive threaded coach screws 32 and 34 extending downwardly therethrough respectively which are received in the cross-tie 36. Preferably, washers 38 and 40 are utilized on the coach screws 32 and 34 respectively. Similarly, a pair of coach screws 42 and 44 extend downwardly through tie plate 18 adjacent field side 22 which is also received by the cross-tie 36. Normally, the cross-tie 36 will be predrilled to receive the coach screws 32, 34, 42 and 44.

A first rectangular-shaped opening 46 is formed in tie plate 18 between shoulder 24 and gauge side 20. Slot 48 communicates with the lower end of slot 46 and extends toward the recessed area 16 beneath the upper surface of the tie plate 18. A second opening 50 is also formed in tie plate 18 which communicates with slot 48 so as to define shoulders 52 and 54 therebetween.

Figure 5:
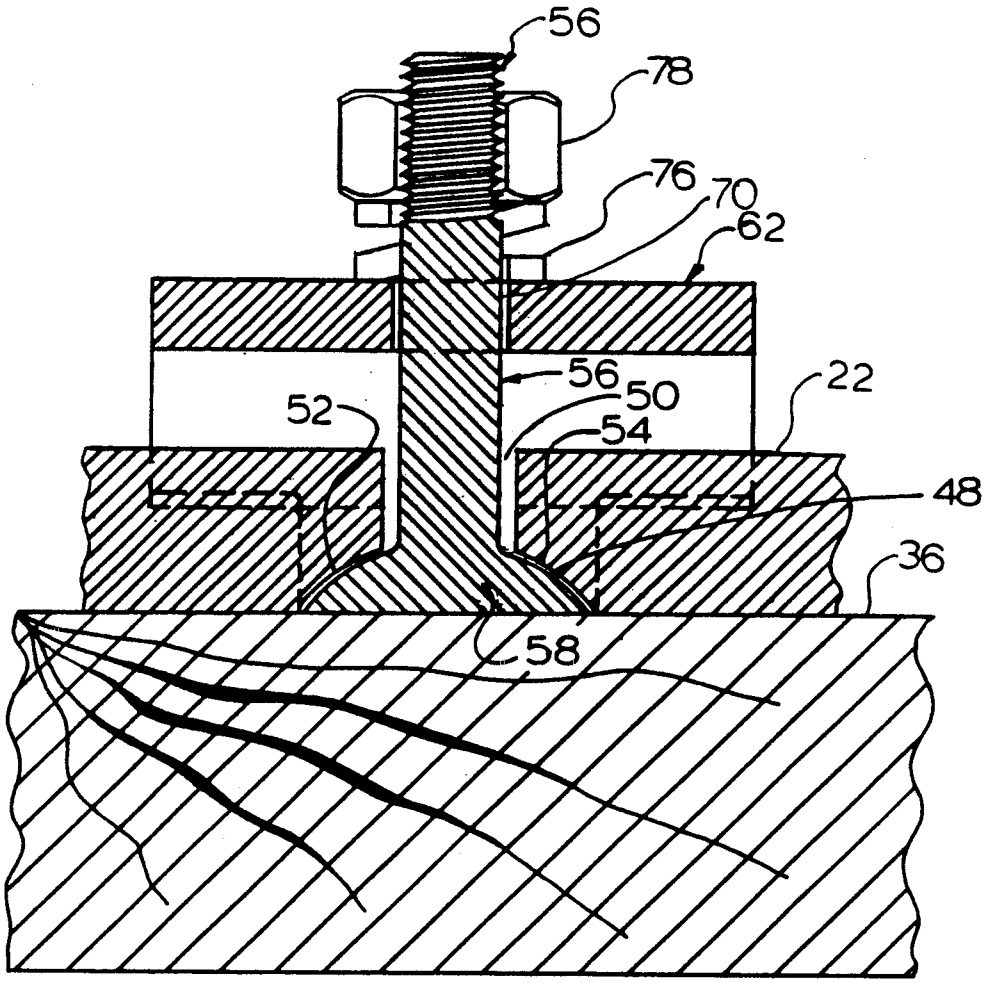
FIG. 5 is a sectional view as seen on lines 5—5 of FIG. 2.
Figure 6:
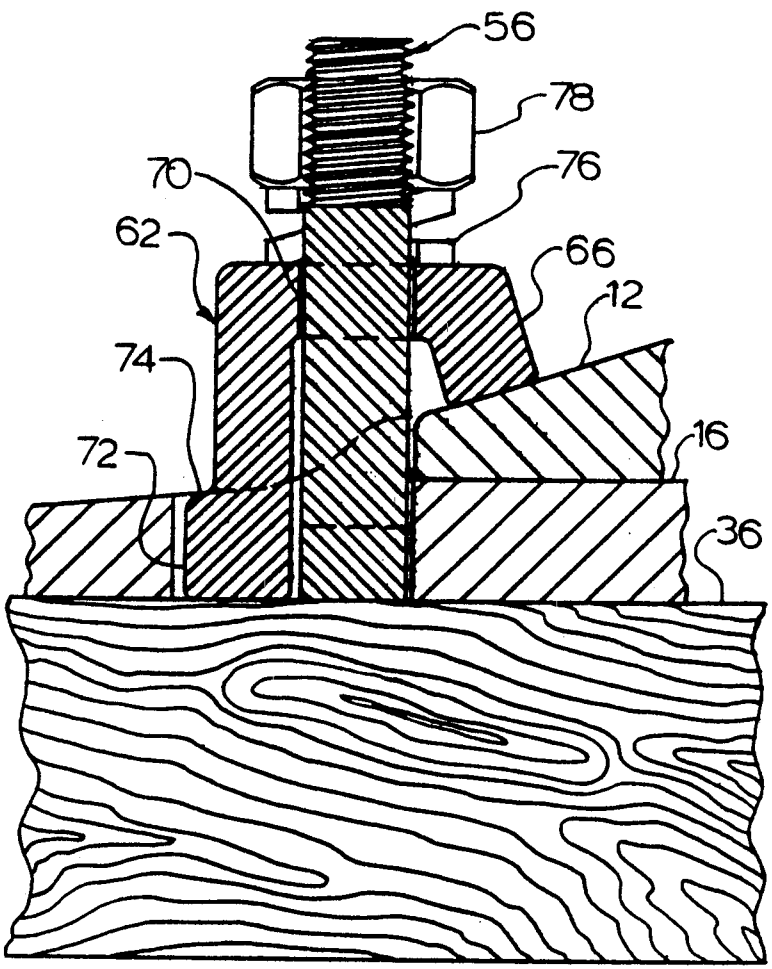
FIG. 6 is a sectional view as seen on lines 6—6 of FIG. 1.
Figure 7:
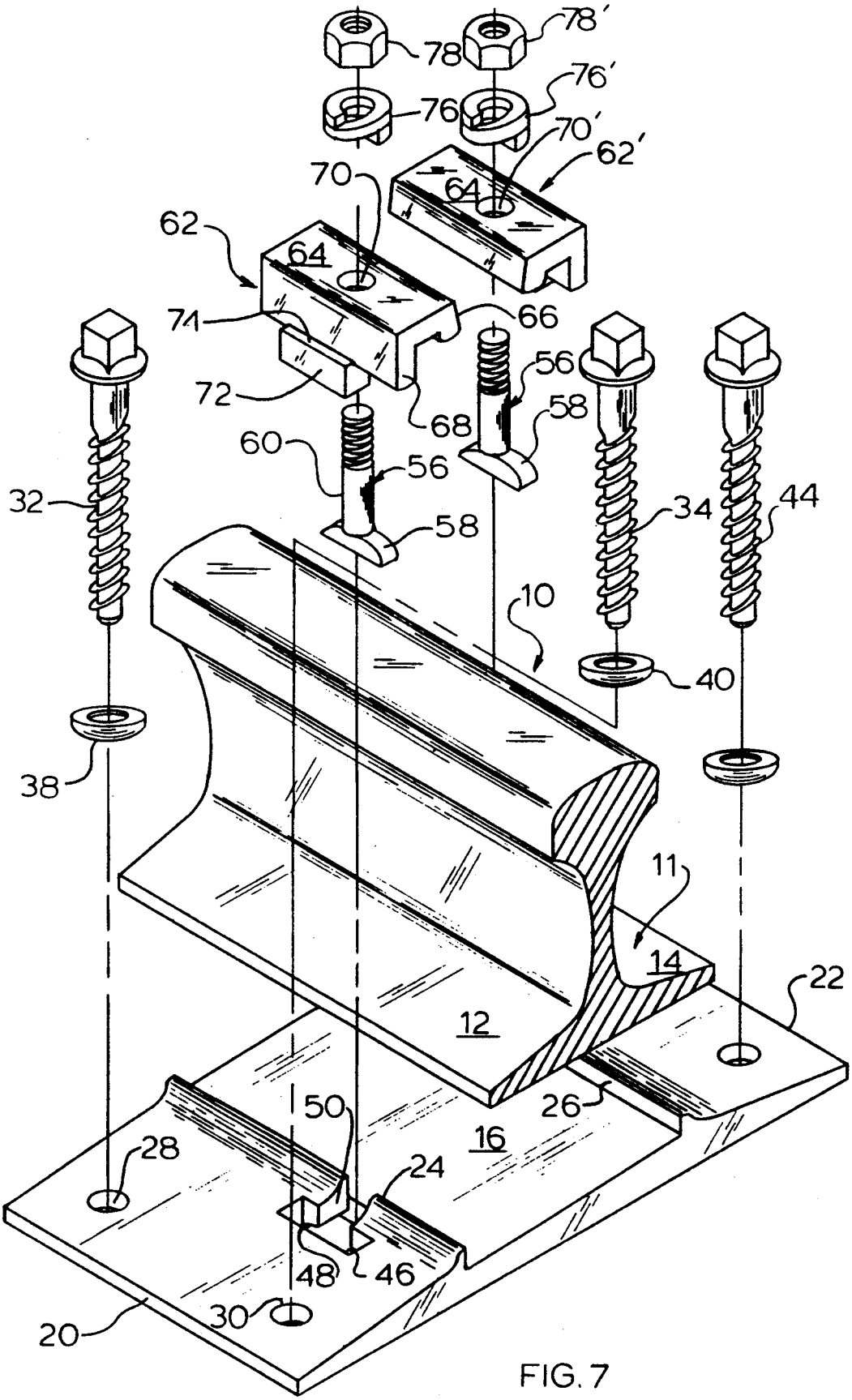
FIG. 7 is an exploded perspective view of the bolted rail fastening system of this invention.

The numeral 56 refers to a clip bolt having a T-shaped head portion 58 and a threaded shank portion 60. Clip bolt 56 is secured to tie plate 18 by inserting the head portion 58 downwardly through the opening 46 and then moving the bolt 56 towards recessed area 16 so that the T-shaped head portion 58 is received in the slot 48 beneath the shoulders 52 and 54. As seen in the drawings, the T-shaped head portion 58 is arcuate so as to be complementary to the arcuate shoulders 52 and 54 to permit bolt 56 to pivot somewhat in the slot 48. Although FIG. 5 illustrates the shoulders 52 and 54 to be arcuate, the shoulders could be horizontally disposed if so desired, although the arcuate-shaped shoulders 52 and 54 are the preferred configuration.

Figure 8:
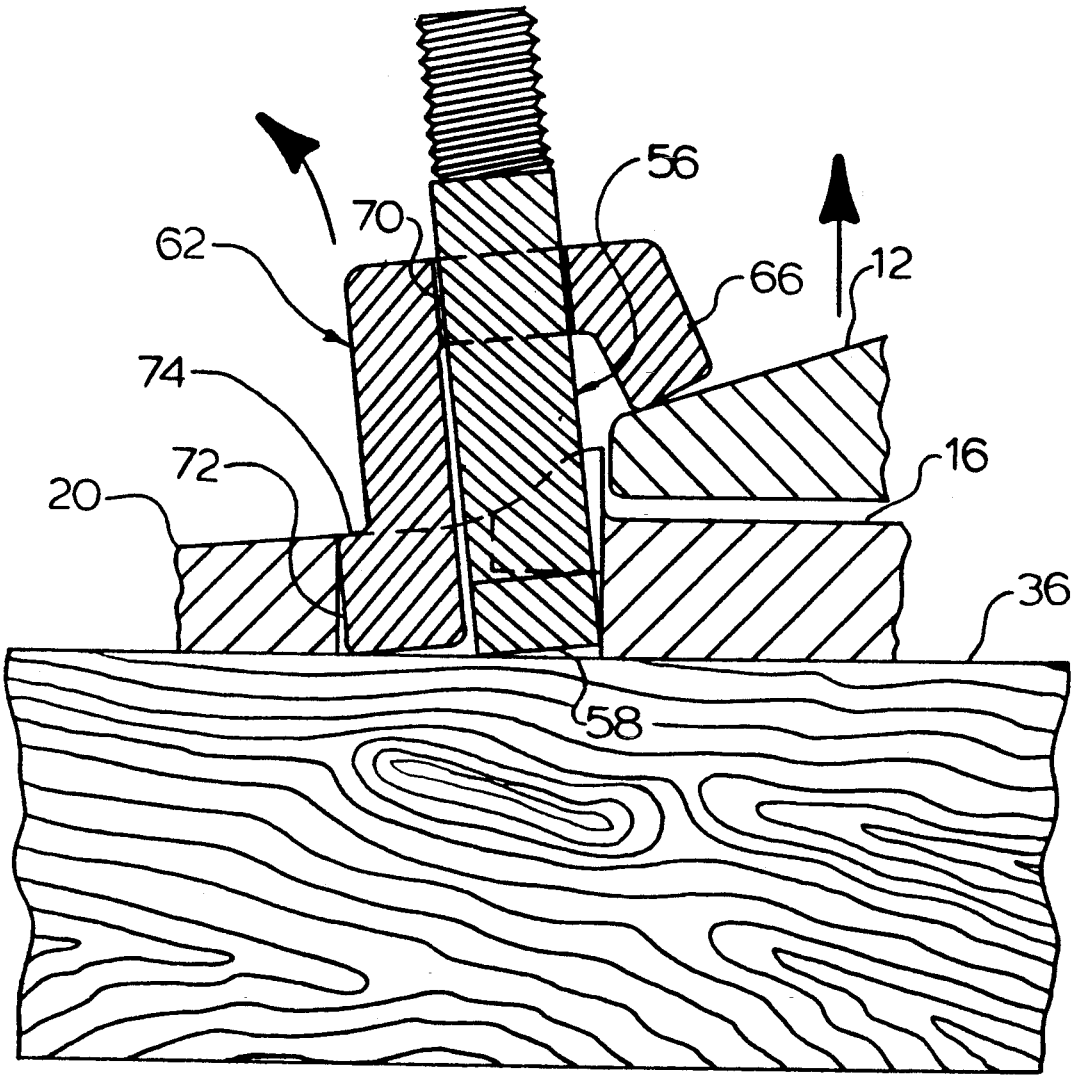
FIG. 8 is a sectional view similar to FIG. 6 except that the nut on the clip bolt has been removed.
Figure 9:
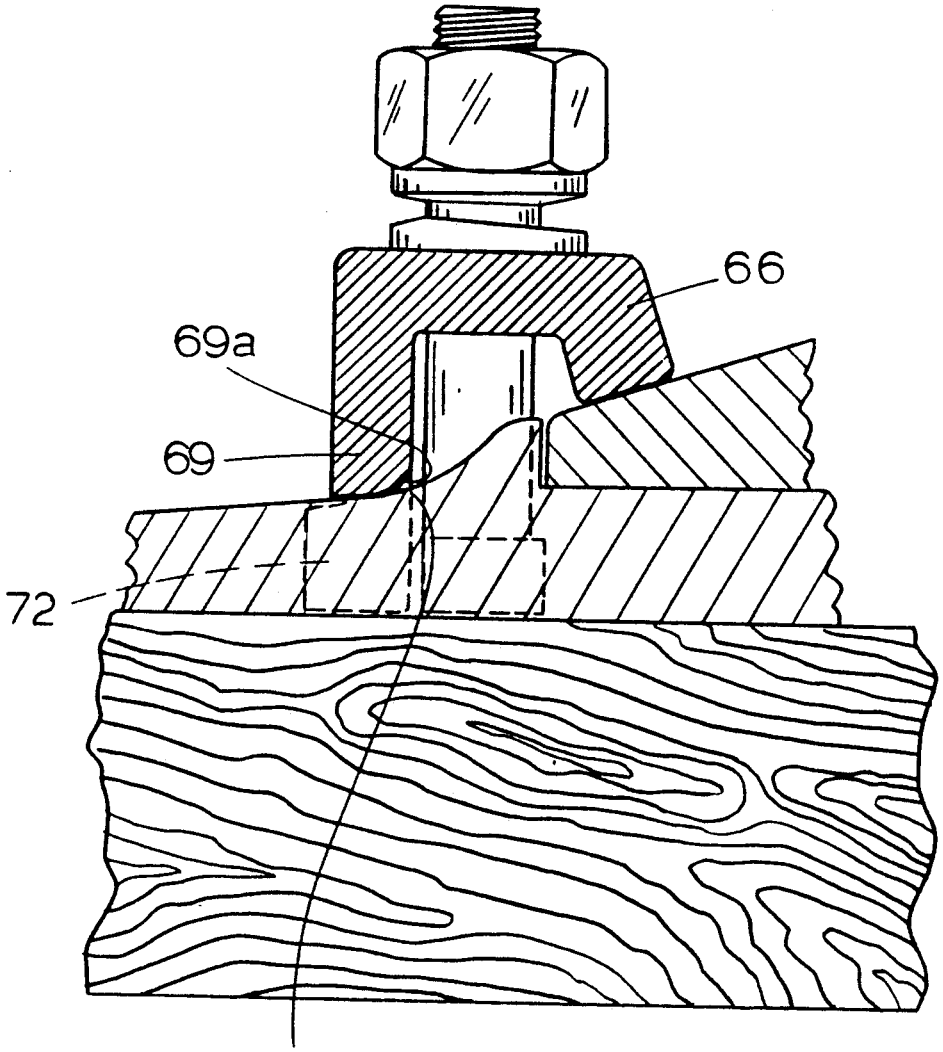
FIG. 9 is a sectional view as seen on lines 9—9 of FIG. 1.

Clip 62 is mounted on clip bolt 56 and includes an upper end portion 64 having an end portion 66 which extends downwardly therefrom for engagement with the upper surface of flange 12. Clip 62 also includes an end portion 68 which extends downwardly from upper end portion 64. End portion 68 is wider than rectangular-shaped opening 46, such that wing portions 69 engage tie plate 18 at opposite ends of the rectangular-shaped opening 46 (see FIG. 9). Upper end portion 64 is provided with an opening 70 formed therein to permit the threaded shank portion 60 of bolt 56 to extend upwardly therethrough. Tooth 72 extends downwardly from the lower end of end portion 68 and includes an offset portion 74 which is disposed laterally of end portion 68 as seen in the drawings. Tooth 72 has a length substantially equal to the length of the rectangular-shaped opening 46 to permit tooth 72 to be received therein. The vertical depth of tooth 72, as measured along offset 74 is at least equal to or greater than the thickness of tooth 72. Tooth 72, when in position, prevents rotation of bolt 56 so that nut 78 may be tightened without the need for a wrench to be used on the lower end of bolt 56. In addition, the depth of tooth 72 prevents significant backward rotation of clip 62 caused by the wedging effect shown in FIG. 8, when rail flange 12 is forced upwardly. Thus, greater vertical displacement of clip 62 than prior art devices, is necessary to disengage the clip and rail, thereby increasing safety and stability.

Wing portions 69 have an arcuate edge **69*a* which bears upon the arcuate reversing fillet 71 of shoulder 24 beyond the ends of rectangular slot 46. Arcuate edges 69*a* of wing portions 69 have a radius which corresponds with reversing fillet 71, thereby allowing the clip to rotate along an axis parallel to the rail so that inner end portion 66 of clip 62 bears firmly against the base flange 12 of rail 10. This rotatability permits adjustment for the cant at recessed area 16**.

When clip 62 is positioned on the bolt 56 and the tooth 72 is in the rectangular-shaped opening 46, the lower end of the tooth 72 is positioned laterally of the T-shaped head portion 58 to maintain bolt 56 in position. Washer 76 and nut 78 are mounted on the upper end of bolt 56 to maintain clip 62 in position.

Figure 10:
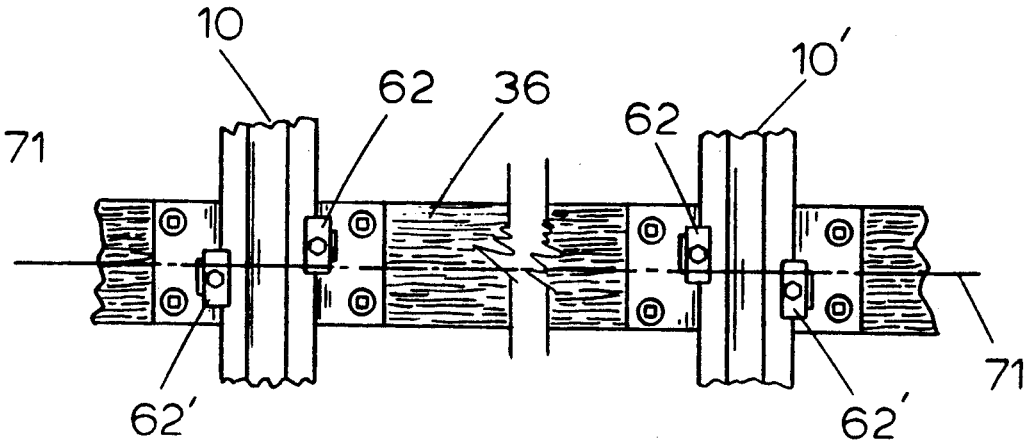
FIG. 10 is a top view of the bolted rail fastening system as applied to a single cross-tie with two rails.

The numeral 62' refers to a clip which is positioned at the opposite side of the rail in an identical fashion to clip 62. As shown in FIG. 10 clips 62 and 62' are located offset from the centerline 71 of cross-tie 36, and on opposite sides thereof, in a staggered formation. This cross-stagger is reversed for the opposite rail 10', so that the gauge-end clips 62 are located on the same side of center line 71 and the field-end clips 62' are on the same side, on rails 10 and 10'. This cross-stagger of clips 62 and 62' eliminates any possible skewing of the cross-ties, maintenance and avoids possible derailments.

The method of installing the bolted rail fastening system and its operation is as follows. Tie plate 18 is installed on the tie 36 by means of the coach screws as previously described. Rail 10 is then positioned in the recessed area 16 as seen in the drawings. The T-shaped head portion 58 of bolt 56 is then extended downwardly through the rectangular-shaped opening 46 and thence laterally into the slot 48 as previously described with the clip 62 then being installed on the bolt 56 as also previously described. When the nut 78 is tightened on the bolt 56, the clip 62 positively maintains the rail 10 on the tie plate 18. If nut 78 becomes loose over a period of time, bolt 56 will be maintained in position inasmuch as tooth 72 prevents bolt 56 from moving laterally in the slot 46 or rotating in the slot 46. If the nut 78 becomes excessively loose or becomes completely disengaged from the bolt 56, the clip 62 will remain on the bolt 56 due to the forces of gravity and will still have its outer end portion 66 positioned over the flange 12 of the rail 10 to provide lateral restraint for the rail 10 so that rail 10 remains in position on the tie plate 18. The clip 62' is installed as previously described and functions in an identical fashion to clip 62.

The fact that the clips 62 and 62' remain on the clip bolts even if the nuts associated therewith become loose ensures that lateral movement of rail 10 will be prevented thereby avoiding the possibility of a derailment. Further, the bolted rail fastening system of this invention permits worn rails to be easily replaced by simply removing the clip assemblies without the need for removing and replacing spikes as in the prior art devices thereby increasing tie life. Thus it can be seen that the invention accomplishes at least all of its stated objectives.

We claim:

1. A bolted rail fastening system for mounting a rail, having a base flange, on a supporting elongated cross-tie, comprising:

a tie plate having an upper surface, and a bottom surface positioned on the cross-tie;

said tie plate having a central recessed area formed in the upper surface thereof for receiving the base flange of the rail therein;

said recessed area being defined by a longitudinally extending first pair of shoulders on said tie plate, said tie plate having a gauge side positioned inwardly of said recessed area and a field side positioned outwardly of said recessed area;

said gauge-side and field-side tie plate shoulders each having an arcuate upper surface, forming a reversing fillet;

said tie plate having at least one opening formed therein adjacent each of the gauge and field sides thereof for receiving a fastening means extending downwardly therethrough into the cross-tie to secure said tie plate to the cross-tie;

said tie plate having a first generally rectangular-shaped opening formed therein extending downwardly therethrough between said recessed area and said gauge side, said first rectangular-shaped opening having its longitudinal axis parallel to the longitudinal axis of the rail;

said tie plate having a first slot formed beneath its upper surface which communicates with the lower portion of said first rectangular-shaped opening and which extends therefrom towards said recessed area;

said tie plate having a second opening formed therein extending downwardly therethrough, from the upper surface thereof, adjacent said recessed area which communicates with said first slot to define a second pair of shoulders therebetween;

a first clip bolt having a generally T-shaped head positioned in said first slot and a shank portion extending upwardly through said second opening, said T-shaped head being prevented from upward vertical movement by said second pair of shoulders, a first clip positioned on said first clip bolt and comprising an upper end portion having inner and outer ends, an outer end portion extending downwardly from the outer end of said upper end portion for engagement with the base flange of the rail, an inner end portion extending downwardly from the inner end of said upper end portion, and a tooth means extending downwardly from the lower end of said inner end portion of said first clip into said first rectangular-shaped opening, said tooth means having a length substantially equal to the length of said first rectangular-shaped opening, said inner end portion having a length greater than said first rectangular-shaped opening to form wing portions in engagement with said tie plate at opposite ends of said first rectangular-shaped opening;

said first clip wing portions having arcuate portions on their lower ends corresponding to said arcuate gauge-side shoulder surface to permit rotational movement of said first clip along an axis parallel to the rail;

said tooth means being positioned inwardly of said T-shaped head portion of said first clip bolt to maintain said T-shaped head portion of said first clip bolt in said first slot and said shank portion in said second opening;

a nut means on the upper end of said first clip bolt for maintaining said first clip thereon;

said tie plate having a second generally rectangular-shaped opening extending downwardly therethrough between said recessed area and said field side, said second rectangular-shaped opening having its longitudinal axis parallel to the longitudinal axis of the rail;

said tie plate having a second slot formed beneath its upper surface which communicates with the lower portion of said second rectangular-shaped opening and which extends therefrom towards said recessed area;

said tie plate having a third opening formed therein extending downwardly therethrough, from the upper surface thereof which communicates with said second slot, to define a third pair of shoulders therebetween;

a second clip bolt having a generally T-shaped head positioned in said second slot and a shank portion extending upwardly through said third opening, said T-shaped head of said second clip bolt being prevented from upward vertical movement by said third pair of shoulders;

a second clip positioned on said second clip bolt and comprising an upper end portion having inner and outer ends, an inner end portion extending downwardly from the inner end of said upper end portion of said second clip for engagement with the base flange of the rail, an outer end portion extending downwardly from the outer end of said upper end portion, and a tooth means extending downwardly from the lower end of said outer end portion of said second clip into said second rectangular-shaped opening, said tooth means having a length substantially equal to the length of said second rectangular-shaped opening, said outer end portion having a length greater than said second rectangular-shaped opening to form wing portions in engagement with said tie plate at opposite ends of said second rectangular-shaped opening;

said second clip wing portions having arcuate portions on their lower ends corresponding to said arcuate field-side shoulder surface to permit rotational movement of said second clip along an axis parallel to the rail;

said tooth means on said second clip being positioned outwardly of said T-shaped head portion of said second clip bolt to maintain said T-shaped head portion of said second clip bolt in said second slot and said shank portion in said third opening;

and a nut means on the upper end of said second clip bolt for maintaining said second clip thereon.

2. The bolted rail fastening system of claim 1 wherein said tooth means on said first clip protrudes inwardly from the inner end of said inner end portion and wherein said tooth means of said second clip protrudes outwardly from the lower end of said outer end portion thereof.

3. The bolted rail fastening system of claim 1, wherein said cross-tie is oriented generally perpendicularly to said rail, and wherein said first clip is offset in one direction from the longitudinal center of said cross-tie and wherein said second clip is offset in an opposite direction from the longitudinal center of said cross-tie, to produce a staggered orientation of the clips with the rail.

4. The bolted rail fastening system of claim 3, further comprising:

a second rail having a base flange, supported on said cross-tie spaced-apart and parallel to said first rail;

a second tie plate having an upper surface, and a bottom surface positioned on the cross-tie;

said second tie plate having a central recessed area formed in the upper surface thereof for receiving the base flange of the second rail therein;

said recessed area being defined by a longitudinally extending fourth pair of shoulders on said second tie plate, said second tie plate having a gauge side positioned inwardly of said recessed area and a field side positioned outwardly of said recessed area;

said second tie plate having at least one opening formed therein adjacent each of the gauge and field sides thereof for receiving a fastening means extending downwardly therethrough into the cross-tie to secure said second tie plate to the cross-tie;

said tie plate having a third generally rectangular-shaped opening formed therein extending downwardly therethrough between said recessed area and said gauge side, said third rectangular-shaped opening having its longitudinal axis parallel to the longitudinal axis of the second rail;

said second tie plate having a third slot formed beneath its upper surface which communicates with the lower portion of said third rectangular-shaped opening and which extends therefrom towards said recessed area;

said second tie plate having a fourth opening formed therein extending downwardly therethrough, from the upper surface thereof, adjacent said recessed area which communicates with said third slot to define a fifth pair of shoulders therebetween;

a third clip bolt having a generally T-shaped head positioned in said third slot and a shank portion extending upwardly through said fourth opening, said T-shaped head being prevented from upward vertical movement by said fifth pair of shoulders;

a third clip positioned on said third clip bolt and comprising an upper end portion having inner and outer ends, an outer end portion extending downwardly from the outer end of said upper end portion for engagement with the base flange of the second rail, an inner end portion extending downwardly from the inner end of said upper end portion, and a tooth means extending downwardly from the lower end of said inner end portion of said third clip into said third rectangular-shaped opening, said tooth means having a length substantially equal to the length of said third rectangular-shaped opening, said inner end portion having a length greater than said third rectangular-shaped opening to form wing portions in engagement with said second tie plate at opposite ends of said third rectangular-shaped opening;

said tooth means being positioned inwardly of said T-shaped head portion of said third clip bolt to maintain said T-shaped head portion of said third clip bolt in said third slot and said shank portion in said fourth opening;

a nut means on the upper end of said third clip bolt for maintaining said third clip thereon;

said second tie plate having a fourth generally rectangular-shaped opening extending downwardly therethrough between said recessed area and said field side, said fourth rectangular-shaped opening having its longitudinal axis parallel to the longitudinal axis of the second rail;

said second tie plate having a fourth slot formed beneath its upper surface which communicates with the lower portion of said fourth rectangular-shaped opening and which extends therefrom towards said recessed area;

said second tie plate having a fifth opening formed therein extending downwardly therethrough, from the upper surface thereof which communicates with said fourth slot, to define a sixth pair of shoulders therebetween;

a fourth clip bolt having a generally T-shaped head positioned in said fourth slot and a shank portion extending upwardly through said fifth opening, said T-shaped head of said fourth clip bolt being prevented from upward vertical movement by said pair of shoulders;

a fourth clip positioned on said fourth clip bolt and comprising an upper end portion having inner and outer ends, an inner end portion extending downwardly from the inner end of said upper end portion of said fourth clip for engagement with the base flange of the second rail, an outer end portion extending downwardly from the outer end of said upper end portion, and a tooth means extending downwardly from the lower end of said outer end portion of said fourth clip into said fourth rectangular-shaped opening, said tooth means having a length substantially equal to the length of said fourth rectangular-shaped opening, said outer end portion having a length greater than said fourth rectangular-shaped opening to form wing portions in engagement with said second tie plate at opposite ends of said fourth rectangular-shaped opening;

said tooth means on said second clip being positioned outwardly of said T-shaped head portion of said fourth clip bolt to maintain said T-shaped head portion of said fourth clip bolt in said fourth slot and said shank portion in said and a nut means on the upper end of said fourth clip bolt for maintaining said fourth clip thereon;

said third clip being offset from the longitudinal center of said cross-tie and parallel to said first clip;

said fourth clip being offset from the longitudinal center of the cross-tie and parallel to said second clip, whereby the third and fourth clips are staggered in reverse of said first and second clips on said cross-tie.

* * * * *